US006425777B1

(12) United States Patent
Yatskov

(10) Patent No.: US 6,425,777 B1
(45) Date of Patent: Jul. 30, 2002

(54) ELECTRICAL CABINET INCLUDING REMOTE CONNECTOR INSERTION

(75) Inventor: Alexander I. Yatskov, Kenmore, WA (US)

(73) Assignee: Cray Inc., Seattle, WA (US)

( * ) Notice: Subject to any disclaimer, the term of this patent is extended or adjusted under 35 U.S.C. 154(b) by 0 days.

(21) Appl. No.: 09/825,630

(22) Filed: Apr. 3, 2001

(51) Int. Cl.[7] ..... H01R 13/627
(52) U.S. Cl. ..... 439/359; 439/372; 439/362
(58) Field of Search ..... 361/752, 753, 361/796, 797; 439/359, 372, 371, 378, 362

(56) References Cited

U.S. PATENT DOCUMENTS 5,431,582 A * 7/1995 Carvalho et al. ..... 439/362
5,733,137 A * 3/1998 Knoop ..... 439/362

* cited by examiner

*Primary Examiner*—P. Austin Bradley
*Assistant Examiner*—Briggitte R. Hammond
(74) *Attorney, Agent, or Firm*—David V. Carlson; Seed IP Law Group PLLC

(57) ABSTRACT

An electrical cabinet configured to accept a number of individual circuit boards and provide a mechanism for remotely interconnecting movable connectors on each circuit board with stationary connectors mounted within the electrical cabinet. The circuit boards are grouped into a number of circuit board assemblies. Each circuit board assembly includes a frame configured to cooperate with a slot in the cabinet to align the movable connector elements on the circuit boards with the stationary connector elements in the cabinet. The circuit boards each include a first mechanism acting from a remote location to gently urge the counterpart connector elements together, and a second mechanism also acting from a remote location to gently disengage the mated connector elements.

24 Claims, 10 Drawing Sheets

ELECTRICAL CABINET INCLUDING REMOTE CONNECTOR INSERTION

CROSS-REFERENCE TO RELATED APPLICATION

This application is related to application Ser. No. 09/825,622, filed on the same date herewith, and to application Ser. No. 09/825,747, filed on the same date herewith, now pending, which applications are incorporated herein by reference in their entirety.

TECHNICAL FIELD

This invention relates to remote insertion of connector pins within an electrical cabinet, particularly employing flexible drive rods.

BACKGROUND OF THE INVENTION

Many applications, including heavily packed computer cabinets and other equipment employing electrically interconnected circuit boards are often configured for electrical connections to an interface board, such as a mother board, back plane, or another circuit board buried deep within the cabinet. Connections in such inaccessible locations generally require blind insertion of connectors on a back edge of the circuit board into mating connectors on the inaccessible interface board. Furthermore, access is generally provided only through a single opening in the cabinet opposite the connector interface. Thus, the board installer is faced with blindly aligning connectors on the circuit board with mating connectors on the back wall of the cabinet. Several methods are known for providing initial alignment of the board within the cabinet. For example, the cabinet wall is often provided with slots configured to accept an edge of the circuit board and align it within the cabinet. In another example, bayonet pins are provided on the back edge of the circuit board to mate with precision holes positioned in the back wall of the cabinet.

SUMMARY OF THE INVENTION

In instances where known circuit board alignment mechanisms often provide proper mating of connectors, the alignment they provide may be too gross to safely mate connectors having large numbers of very delicate connections. Although the housings of such connectors are typically formed with corresponding guide pins or another lead in mechanism, an aggressive installation often does not provide sufficient opportunity for slender male pins to properly align with correspondingly narrow female receptacles. In such instances, the fragile pins generally require a gentle easing together of the mating connector elements for successful insertion of the slender male pins to avoid bending and other damage. One or more of the male pins may fail to completely align with its female counterpart and become bent or completely crushed during installation. The connector installation device of the present invention provides both the initial alignment within the cabinet and the controlled force needed to gently and certainly engage connector elements, without damage.

The present invention provides an electrical cabinet that accepts a number of individual circuit boards and further provides a mechanism for remotely interconnecting movable connector elements on each circuit board with stationary connector elements mounted within the electrical cabinet. According to one aspect of the invention, the circuit boards are grouped into a number of circuit board assemblies. Each circuit board assembly includes a frame configured to cooperate with a slot in the cabinet to align the movable connector elements on the circuit boards with the stationary connector elements in the cabinet. According to another aspect of the invention, the circuit boards each include a first mechanism acting from a remote location to gently urge the counterpart connector elements together, and a second mechanism also acting from a remote location to gently disengage the mated connector elements.

According to various aspects of the invention, the present invention provides an electrical cabinet and circuit board assembly having an electrical cabinet formed with an array of slots each having access provided adjacent to a first surface of the cabinet and a connector end adjacent to a second opposing surface of the cabinet, and one or more stationary connector elements adjacent to the connector end of the slots. Each of the stationary connector elements defines a connector engagement axis. The invention includes one or more circuit boards adapted for entry into different slots. The circuit boards each include a second connector element movable along the connector engagement axis for interconnecting with the first stationary connector element, an internally-threaded member that is positionally fixed on the circuit board relative to the connector engagement axis, and a rotary drive insertion device having a substantially flexible, externally-threaded rod executing at least one directional change between a first drive input end and a second drive output end, the drive output end engaged with both the internally-threaded member and the second connector element for moving the second connector element along the engagement axis.

According to one aspect of the invention, the flexible rod describes a predetermined curving trajectory between the first drive input end and the second drive output end that includes the directional change.

According to another aspect of the invention, a stanchion is included on the circuit board for restraining the first drive input end of the flexible rod for motion along the predetermined trajectory.

According to another aspect of the invention, a tubular guide is included on the circuit board and surrounds at least a portion of the flexible rod.

According to various other aspects of the invention, the present invention provides a circuit board assembly installation device wherein each circuit board in the assembly includes a connector element that is movable along an engagement axis with a mating fixed connector element fixed on an interface board within the cabinet. The movable connector element is formed with an insertion drive surface oriented relatively to the engagement axis. An insertion cam positioned proximately to the movable connector element includes an actuation surface facing and mating with the insertion drive surface of the moveable connector. The insertion cam is controllable from a remote location and movable perpendicular to the engagement axis of the mating connector elements. An insertion drive mechanism pushes the insertion cam along an installation axis that is substantially perpendicular to the engagement axis. A drive force applied to the insertion drive mechanism moves the actuation surface of the insertion cam along the installation axis and into contact with the insertion drive surface of the moveable connector element. Pressure of the actuation surface against the movable connector urges the movable connector element along the engagement axis toward the fixed connector element. The gentle easing of the engagement of the moveable and fixed connector elements allows sufficient opportunity for guidance mechanisms on the connector housings to orient the pins for insertion into the corresponding female receptacles.

According to one aspect of the invention, initial alignment within an electrical cabinet is provide by an array of slots within the electrical cabinet. Each slot has access provided adjacent to one surface of the cabinet and a connector end of the slot adjacent to an opposite surface of the cabinet. The stationary connector elements are provided adjacent to the connector end of the slots, for example, as components mounted on an interface board, such as a mother board, back plane, or another circuit board buried deep within the cabinet. According to various aspects of the invention, initial alignment is further provided to different circuit board assemblies, each including multiple circuit boards secured relative to a frame, by providing guides within the elongated slots that slidingly engage the frame of the circuit board assembly. Preferably, the frame is provided with either or both of a precision width dimension and a precision height dimension, while each slot is provided with a corresponding precision dimension sufficiently larger to permit a sliding fit of the frame therein.

According to various other aspects of the invention, the insertion cam is formed in a wedge-shape with an inclined surface. An inclined actuation surface of the insertion cam engages a matchingly inclined insertion drive surface on the moveable connector element. Preferably, the insertion cam is slidingly engaged with a guide channel that supports the insertion cam and directs it along the installation axis.

According to another aspect of the invention, an extraction cam is provided to disengage the moveable connector element from the stationary connector element. Accordingly, an extraction drive surface is provided on the movable connector element facing toward but spaced away from the insertion drive surface. An extraction cam configured similarly to but oppositely from the insertion cam is driven by an extraction drive on an extraction axis parallel to but spaced away from the insertion axis. An inclined surface on the extraction cam engages the extraction drive surface and gently eases the movable connector element along the engagement axis away from the fixed connector element. The extraction cam is slidingly engaged with an extraction cam guide that supports the extraction cam and directs it along the extraction axis.

According to still another aspect of the invention, the insertion and extraction drivers are alternatively either rigid or flexible threaded drive elements. According to various aspects of the present invention, the flexible drive elements are compressively wound helical coil springs threadedly engaged with internally threaded nuts matched thereto in diameter and pitch. The flexible drive elements are able to undergo directional changes that allow the drive torque to be input both spatially and dimensionally remotely from the respective insertion and extraction cams.

According to yet other aspects of the present invention, methods are provided that utilize the insertion and extraction cams in combination with the insertion and extraction drivers to alternately engage and disengage the fixed and mobile connector elements.

DETAILED DESCRIPTION OF THE INVENTION

Figure 1:
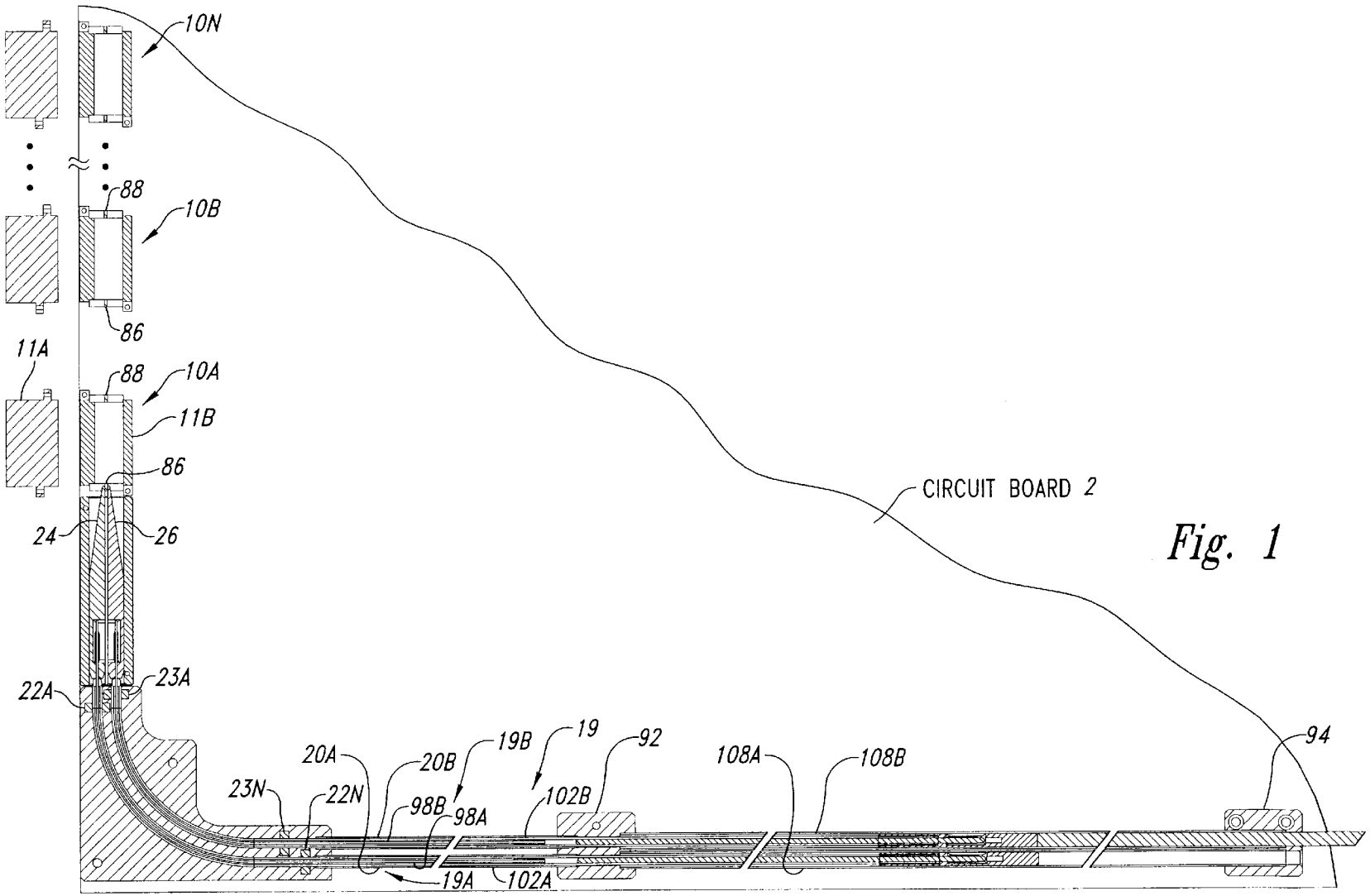
FIG. 1 illustrates one embodiment of a flexible drive of the invention for connecting remote electrical contacts and an embodiment of the electrical contacts for use with the flexible drive.

FIG. 1 illustrates a circuit board 2, including one embodiment of the flexible drive for connecting remote electrical contacts and an embodiment of the electrical connectors for use with the flexible drive. The invention is described, for exemplary purposes only, using an electrical connection of the type described in U.S. Pat. No. 4,975,074, which is incorporated in its entirety herein by reference. The invention is not intended to be limited in any way by the use of the description of the electrical connection of the type described in U.S. Pat. No. 4,975,074. Rather, the invention is intended to generally encompass the remote installation of mobile connector elements into mating stationary connector elements. Electrical connector 10A is shown in FIG. 1 having a first connector element 11A mounted in a stationary position on an inaccessible surface of the computer or electrical cabinet. For example, stationary connector element 11A is mounted on an electrical interface board, such as a mother board, back plane, or another circuit board of a computer system positioned oppositely from the access panel for installing circuit boards 2. Optionally, stationary connector element 11A is mounted on the back plane of an electrical equipment cabinet. The present invention is applicable to either of these specific applications, or another suitable application requiring remote insertion of electrical or mechanical connectors in a difficult access area. A mating mobile connector element 11B is mounted on circuit board 2 being installed in the cabinet.

Also illustrated in FIG. 1 is the flexible actuator unit 19 for remotely inserting electrical connectors. In a preferred embodiment, flexible actuator 19 includes two actuator drives, an insertion actuator 19A and an extraction actuator 19B. As will be described in greater detail below, insertion actuator 19A and extraction actuator 19B include respective threaded actuator drives 20A and 20B, which are each formed of a tightly wound helical coil tension spring. Each of flexible actuator drives 20A, 20B are threadedly engaged with a respective threaded member 22, 23, which is mounted on the circuit board to be installed. Threaded members 23, 23 are, for example, a nut or an internal thread cut in a metal or plastic plate. Preferably, threaded element 22, 23 is positioned by a stanchion 25 fixed on the circuit board. Threaded elements 22, 23 are optionally threads cut in stanchion 25. One or more internally threaded members 22A through 22N threadingly engage the coils of insertion actuator drive 20A, while one or more threaded members 23A through 23N threadingly engage extraction actuator drive 20B. As will be discussed below in detail, a rotational force applied to either actuator 19A or 19B causes the respective flexible actuator drive 20A or 20B to advance or retract along the longitudinal axis of respective threaded member 22, 23, thereby translating the applied rotational force into a linear force directed along the longitudinal axis of respective threaded member 22 and 23.

Insertion actuator unit 19A includes an insertion cam 24. As will be discussed below in detail, insertion cam 24 is driven by insertion actuator drive 20A to engage the electrical contacts of mobile connector element 11B with mating contacts of stationary connector element 11A. Extraction actuator drive 20B drives extraction cam 26 of extraction actuator unit 19B to disengage mobile connector element 11B from stationary connector element 11A. Optionally, one or more additional connectors 10B through 10N are similarly engaged and disengaged by respective ones of insertion actuator unit 19A and extraction actuator unit 19B.

Figure 2A:
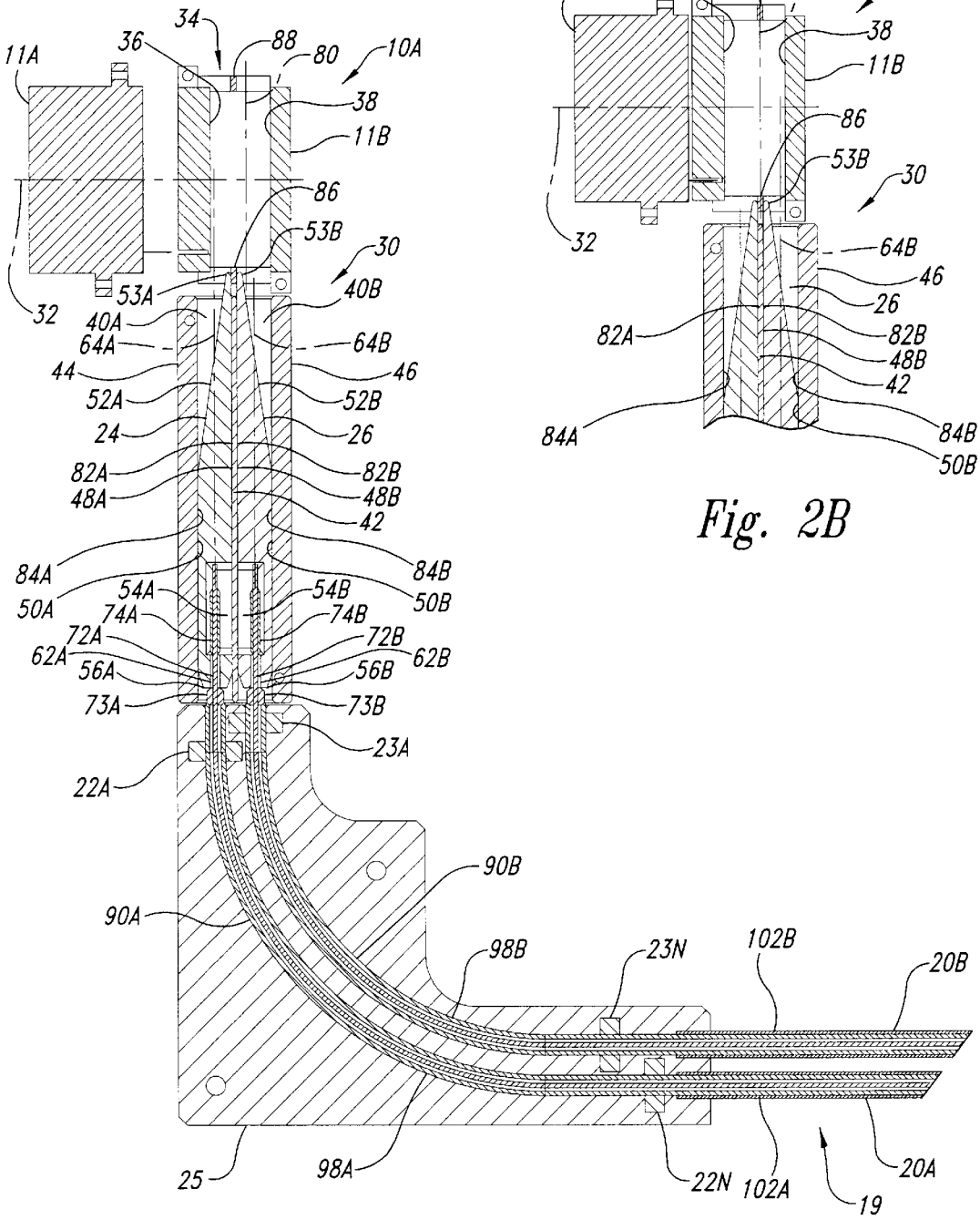
FIG. 2A illustrates a connector having a movable connector element for mating with a stationary connector element and an actuator for engaging the connector elements according to one embodiment of the invention.

FIG. 2A illustrates details of connector 10 and actuator cam assembly 30. In FIG. 2A, stationary connector element 11A is fixed relative to a mother board, back plane or wall of a computer or other electrical equipment enclosure or cabinet (not shown). Mating connector element 11B, however, is mounted on circuit board 2 in a manner that permits electrical connector element 11B a degree of mobility along an engagement axis 32, while restricting motion in other directions or dimensions.

Mobile connector element 11B is formed with a slot 34 having an opening configured as a cavity or slot with substantially parallel internal walls 36, 38 oriented substantially perpendicularly relative to engagement axis 32. Cam assembly 30 includes both insertion cam 24 and extraction cam 26 within an actuator guide 40, which is formed as a linear cavity. According to preferred embodiments, actuator guide 40 is further at least partially subdivided by a bisecting wall 42 oriented substantially parallel with a longitudinal axis (not shown) of linear cavity 40 and centrally positioned within cavity 40. Bisecting wall 42 defines, in combination with respective exterior walls 44, 46 two substantially coextensive actuator guides 40A and 40B, which are formed as two substantially equally sized parallel linear cavities. Insertion cam 24 and extraction cam 26 are contained within respective actuator guides 40A and 40B. Insertion cam 24 is formed with two substantially parallel and spaced apart support surfaces 48A and 50A. An actuation surface 52A is angularly inclined between support surfaces 48A and 50A, whereby insertion cam 24 is formed as a wedge-shaped element. Inclined actuation surface 52A slopes from first support surface 50A towards a second support surface 48A and forms a preferably blunt point with support surface 48A; the blunt point defining an actuator tip 53A of insertion cam 24. Furthermore, a cavity 54A is formed in insertion cam 24 between support surfaces 48A, 50A. Means are provided at an end of insertion cam 24 opposite actuator tip 53A for rotatably attaching insertion actuator drive element 20A.

Insertion cam 24 is sized to slidingly fit within linear cavity 40A for motion along longitudinal axis 64A of cavity 40A without excessive lateral or side play. Insertion cam 24 is rotatably connected to insertion actuator drive 20A in a manner substantially restricting separation between insertion actuator drive 20A and insertion cam 24. For example, a passage 62A is formed between cavity 54A and a driven end 56A. A drive wire or rod 72A fixed relative to insertion actuator drive 20A extends through passage 62A into cavity 54A within insertion cam 24. Drive rod 72A is fixed therein against relative axial motion between insertion actuator drive 20A and insertion cam 24, while retaining rotational freedom relative to insertion cam 24. Relative axial motion between insertion actuator drive 20A and insertion cam 24 is restricted by, for example, expanding the diameter of drive rod 72A within cavity 54A. According to one embodiment of the invention, a metallic ferrule 74A, for example, a bronze ferrule, is fixed to drive rod 72A within cavity 54A. For example, ferrule 74A is mechanically bonded to drive rod 72A by any of staking, welding, soldering, adhesive bonding, or another suitable mechanical fixing method. Preferably, rotation of drive rod 72A relative to stanchion 25 is eased by a bushing or bearing 73A.

Insertion cam 24 assembled to insertion actuator drive 20A as described is installed in linear cavity 40A of cam assembly 30. Preferably, support surfaces 48A and 50A of insertion cam 24 are spaced apart a predetermined distance corresponding to distance D between drive surfaces 36, 38, which define the interior walls of slot 34 in mobile connector element 11B. The correspondence between the thickness of insertion cam 24 and distance D between drive surfaces 36, 38 is such that complete insertion of cam 24 into slot 34 ensures that mobile connector element 11B is moved laterally from a predetermined disengaged position adjacent to but spaced-away from stationary connector elements 11A to completely engage stationary connector element 11A.

Operationally, when circuit board 2 is installed within the computer or electrical cabinet, stationary connector element 11A is mounted on a plane at the back of the cabinet with its engagement surface projecting toward the seated position of circuit board 2 adjacent to the edge of circuit board 2. Mobile connector element 11B is disposed in a first position set slightly away from interconnection with stationary connector element 11A when circuit board 2 is seated. When mobile connector element 11B is in its first pre-engagement position, cam assembly 30 is fixed to circuit board 2 adjacent to mobile connector element 11B, such that longitudinal axis 64 of linear actuator guide 40A is substantially parallel to a linear actuation and extraction axis 80. Axis 80 is defined as an axis perpendicular to engagement axis 32 and bisecting slot 34 of mobile connector element 11B parallel to interior drive surfaces 36, 38 thereof. Linear actuator guide 40A of actuator cam assembly 30 is disposed parallel to axis 80 and offset along engagement axis 32 toward stationary connector element 11A. Linear cavity 40A slightly overlaps slot 34 of mobile connector element 11B, such that an interior wall of linear actuator guide 40A, as defined by a wall of interior partition wall 42, is slightly offset from interior cavity drive surface 36 of slot 34 toward interior cavity drive surface 38. Insertion cam 24 is positioned within linear actuator guide 40A of actuator cam assembly 30, such that inclined actuation surface 52A faces toward first interior drive surface 36 of slot 34 and stationary connector element 11A, with actuator tip 53A positioned adjacent to the opening in slot 34.

Rotational force provided at insertion actuator drive 20A is converted by engagement with threaded member 22A into linear force directed along longitudinal axis 64A of actuator guide 40A by means of drive rod 72A, which presses against a surface of insertion cam 24 opposite actuator tip 53A. Initially, actuator tip 53A is situated outside of slot 34 of mobile connector element 11B adjacent to first insertion drive surface 36. The overlap between actuator guide 40A and slot 34 permits actuator tip 53A of insertion cam 24 to enter slot 34 and engage first insertion drive surface 36 of slot 34 at a point adjacent to cam assembly 30. Initial rotational force applied to insertion actuator drive 20A is converted into linear translational force at drive rod 72A that moves actuator tip 53A of insertion cam 24 into slot 34 of mobile connector element 11B and into contact with first insertion drive surface 36 thereof. Sustained rotational force applied to insertion actuator drive 20A is converted into a relatively smooth, continuous linear translational force at drive rod 72A, which continues to move insertion cam 24 linearly along longitudinal axis 64 of linear actuator guide 40A. Continued linear motion of insertion cam 24 increasingly engages inclined actuation surface 52A with first insertion drive surface 36. The pressure of the inclined actuation surface 52A against first insertion drive surface 36 is supported by insertion cam support surfaces 48A, 50A against respective interior support surfaces 82A and 84A within linear actuator guide 40A. Actuator guide 40A thus supports against insertion cam 24 pushing mobile connector element 11B away from stationary connector element 11A. Mobile connector element 11B, having no translational constraints along engagement axis 32, is thus urged by interaction with insertion cam 24 to move along engagement axis 32 toward stationary connector element 11A. Preferably, one or more insertion guides (not shown) formed in mating connector elements 11A and 11B guide the final interconnection of the connector elements along engagement axis 32, as is well-known in the art. Furthermore, male pins and female ports within respective connector halves 11A and 11B are formed with mating insertion guides, such as chamfers or rounds and countersinks, which are well-known in the art. The degree of incline provided on inclined actuation surface 52A determines the rate at which mobile connector element 11B is inserted into stationary connector element 11A. Preferably, inclined actuation surface 52A is inclined at a minimal slope, for example an angle less than 30 degrees, that gently urges insertion of male pins into female receptacles. However, the invention is alternately practiced with inclined actuation surface 52A of insertion cam 24 inclined at greater angles.

One or more additional cam supports 86, 88 are stationary actuator guides mounted on circuit board 2 at opposing openings of slot 34 in mobile connector element 11B. Additional actuator guides or cam supports 86, 88 provide continued support against twisting or lateral motion of insertion cam 24 as drive tip 53A and insertion cam 24 leave the confines of linear cavity 40A, thus losing the restraint of support surfaces 48A, 50A with respect to respective interior support surfaces 82A, 84A. A first cam support 86 provides continued support to insertion cam 24 at a first or entry end of slot 34, while second insertion cam support 88 engages actuator tip 53A and lends physical support to continued linear motion of insertion cam 24 along longitudinal axis 64A beyond first connector element 11B. According to one or more embodiments of the present invention, additional connectors 10B through 10N are disposed along the edge of circuit board 2 in series with connector 10A. According to such configurations, continued rotational force exerted on insertion actuator drive 20A drives insertion cam 24 linearly along longitudinal axis 64A into engagement with a slot 34 in a next mobile connector element 11B positioned along the edge of circuit board 2 adjacent to first mobile connector element 11B. Additional insertion cam supports 86, 88 positioned along a circuit board relative to each of additional connectors 10B through 10N provide continued directional guidance for insertion cam 24 along longitudinal axis 64A. Additional supports 86, 88 also provide a reaction surface that supports insertion cam 24 when inclined actuation surface 52A engages insertion drive surface 36 of subsequent mobile connector elements 11B.

An ability to disengage previously engaged connector elements 11A and 11B without damaging the delicate connector pins is also desirable. Before disengaging mobile connector elements 11B from connector elements 11A, insertion cam 24 is retracted into cam assembly 30. A reversing rotational force is applied to insertion actuator drive 20A that threadedly retracts insertion actuator drive 20A through threaded member 22A, pulling with it drive rod 72A. Ferrule 74A fixed to drive 72A and entrapped within cavity 54A necessarily pulls insertion cam 24 back along longitudinal axis 64A through cavities 34 of each of the one or more mobile connector elements 11B arranged along the edge of circuit board 2 and into cam assembly 30. Preferably, driven end 56A of insertion cam 24 includes a chamfer, bevel, or round to ease passage of cam supports 86, 88 and re-entry into slot 34 of each moveable connector element 11B.

FIG. 2A also illustrates the extraction actuator drive 20B transmitting a linear translational extraction force to an extraction cam 26 via a second drive rod 72B. Rotation of drive rod 72B relative to stanchion 25 is preferably eased by bushing or bearing 73B.

Figure 2B:
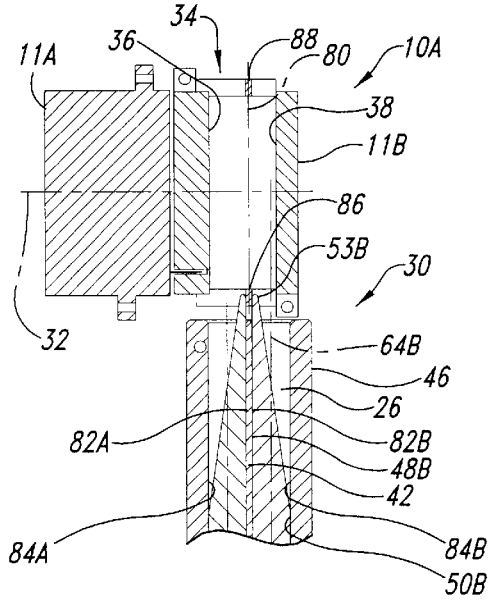
FIG. 2B illustrates a connector having a movable connector element for mating with a stationary connector element and an actuator for disengaging the connector elements according to one embodiment of the invention.

FIG. 2B illustrates the extraction of mobile connector elements 11B from engagement with stationary connector elements 11A along respective engagement axes 32. Actuator cam assembly 30 includes a second linear actuator guide 40B defined by internal support surfaces 82B and 84B, which in turn define a longitudinal axis 64B. Preferably, linear actuator guide 40B shares interior partition wall 42 with linear actuator guide 40A, as described above. Extraction cam 26 of actuator 19B is configured similarly to insertion cam 24, having an inclined actuator surface 52B configured similarly to inclined actuator surface 52A and facing oppositely from inclined actuator surface 52A. Extraction cam 26 further includes an actuator tip 53B formed oppositely from a driven end 56B. Actuator tip 53B, like actuator tip 53A of insertion cam 24, is formed as the tip of wedge-shaped extraction cam 26. Similarly to insertion cam 24, extraction cam 26 includes spaced apart substantially parallel surfaces 48B and 50B coinciding with respective internal support surfaces 82B and 84B that cause extraction cam 26 to move in a substantially straight line parallel with longitudinal axis 64B of actuator guide 40B, substantially without either lateral or rotational motion. Spaced apart surfaces 48B and 50B of extraction cam 26 are joined at actuator tip 53B by an inclined actuator surface 52B sloping from a first surface 50B of extraction cam 26 adjacent to external wall 46 and toward a second surface 48B of extraction cam 26 adjacent to interior partition wall 42. Inclined actuator surface 52B thus faces away from inclined actuator surface 52A of insertion cam 24.

Prior to activation of extraction cam 26, while mobile connector element 11B is engaged with stationary connector 11A, linear actuator guide 40B is situated adjacent to and slightly overlapping with slot 34 of mobile connector element 11B. Actuator tip 53B of extraction cam 26 is positioned adjacent to second drive surface 38 of mobile connector element 11B, with inclined actuation surface 52B within the gap defined by the overlap between actuator guide 40B and slot 34 and facing toward second extraction drive surface 38. The rotational drive force applied to extraction drive member 20B and translated into a linear force by engagement with threaded member 23B acts along drive rod 72B in line with longitudinal axis 64B. Drive rod 72B pushes against an inner surface of cavity 54B formed within extraction cam 26 to move extraction cam 26 along linear actuator guide 40B and into slot 34 of mobile connector element 11B adjacent to extraction drive surface 38. As extraction cam 26 moves into slot 34, extraction actuator tip 53B engages extraction drive surface 38 and exerts a disengagement force thereon. The slope or inclination of inclined actuation surface 52B increasingly engages extraction drive surface 38 as extraction cam 26 is driven deeper into slot 34 as a function of continued rotational force applied to extraction actuation drive 20B. The slope or inclination of inclined actuation surface 52B translates the linear drive force exerted along longitudinal axis 34B by drive rod 72B into a linear disengagement force acting in a direction parallel to engagement axis 32 and oppositely from stationary connector element 11A.

Parallel surfaces 48B, 50B defining the body of extraction cam 26 are spaced apart a predetermined distance corresponding to distance D separating first and second drive surfaces 36, 38 of mobile connector element 11B, such that complete insertion of extraction cam 26 within slot 34 results in complete disengagement of mobile connector element 11B from stationary connector element 11A.

Cam supports 86, 88 are configured with a thickness measured parallel to engagement axis 32 that is substantially identical to the thickness of interior partition wall 42 of cam assembly 30. Therefore, each of cam supports 86, 88 provides support and guidance for extraction cam 26 to maintain the motion of extraction cam 26 along longitudinal axis 64B. As extraction cam 26 exits the confines of actuator guide 40B, cam supports 86, 88 prevent both lateral and rotational motion of extraction cam 26, as discussed above in connection with insertion cam 24. In an embodiment of the invention including multiple connectors 10A through 10N arranged along the edge of circuit board 2, as described above, continued rotational force applied at extraction actuator drive 20B causes continued linear motion of extraction cam 26 along longitudinal axis 64B, whereby extraction cam 26 engages a next initially engaged mobile connector element 11B of a next connector 10B. The interaction of inclined actuation surface 52B with second extraction drive surface 38 gently eases the pins of one of connector elements 11A, 11B out of engagement with the female receptacles of the other connector element 11A, 11B by pushing with a steady pressure against second extraction drive surface 38. Mobile connector element 11B is thereby slowly and gently eased along engagement axis 32 away from stationary connector element 11A.

FIGS. 1 and 2 further illustrate the optional curving nature of insertion actuator drive 20A and extraction actuator drive 20B, wherein each undergoes a directional change. As described above in connection with FIGS. 1 and 2, each of insertion actuator drive 20A and extraction actuator drive 20B includes a respective externally threaded, elongated member or rod 98A and 98B threadedly engaged with a respective internally threaded member 22 and 23. In a preferred embodiment, internally threaded members 22, 23 are hex nuts of a standard diameter and thread pitch that comply with one of the well-known and commercially useful machine thread standards. Optionally, threaded members 22, 23 are internal threads cut into the body of a block or plate, such as stanchion 25. Insertion and extraction drive elements 20A and 20B include tightly coiled helical springs 98A, 98B, the coils of which define a diameter and pitch substantially corresponding to the threads of respective threaded member 22, 23. As is generally known, a tightly coiled helical tension spring generally forms a substantially straight tubular structure that is inherently flexible or bendable as a function of such factors as: the stiffness of the wire, the wire diameter, and diameters of the individual coils. Threaded members 22 and 23 are preferably positioned downstream from a directional change in respective insertion drive element 20A and extraction drive element 20B. Threaded members 22 and 23 are also preferably positioned relatively near cam assembly 30 which houses both insertion cam 24 and extraction cam 26. In other words, directional changes occur between the rotational drive input for respective drive elements 20A and 20B and respective threaded members 22 and 23. In such a configuration, a rotational drive force applied to either insertion actuator drive 20A or extraction actuator drive 20B interacts with respective threaded member 22, 23 to pull respective helical coil spring 98A, 98B through the directional change. Alternatively, threaded member 22, 23 is located between the rotational drive input point and the directional change, whereby the rotational input force interacts with threaded member 22, 23 to pull a straight section of helical coil spring 98A, 98B into the curvature and push it through the curvature. As illustrated, more than one internally threaded member 22, 23 is optionally used with respective insertion and extraction drive elements 20A, 20B. Accordingly, threaded members 22, 23 are positioned at the entrance to and exit from the directional change, whereby helical coil spring 98A, 98B is both pushed into and pulled through the change in direction.

Preferably, helical coil spring 98A, 98B is wound with a diameter slightly less than the diameter of respective threaded member 22, 23 and having a slightly coarser thread pitch as defined by the pitch of the individual coils. Each of helical coil springs 98A, 98B are tightly wound tension springs with adjacent coils compressed against one another with an initial compressive force. Windings are wound in a direction relative to respective threaded member 22, 23 such that a rotational force applied to advance helical spring 98A, 98B through the threaded member tends to increasingly compress adjacent coils against one another. The increased axial compression in turn tends to cause the spring diameter to increase to fill the slightly larger diameter of the threaded member, while the slight shortening of pitch causes the thread pitch defined by the coils to more precisely match the thread pitch of respective threaded member 22, 23. The increased diameter and shortened thread pitch results in more complete engagement of the threads of the coil spring with the threads of respective threaded member 22, 23. More complete engagement allows a greater conversion of torque developed in the helical spring into linear force directed along the longitudinal axis of the helical spring. Thus, a greater linear translational force is developed at respective drive rod 72A and 72B. In contrast, an opposite or retractive rotational force applied to a respective one of insertion drive element 20A and extraction drive element 20B tends to stretch the respective helical coil, separating the individual coils and tilting them slightly relative to the longitudinal axis of the helical spring. This stretching of the helical spring is avoided by use of a compressively wound spring. The compressive force between adjacent coils retains the threaded configuration sufficiently to move helical spring 98A, 98B through respective threaded member 22, 23. Thus, extraction of either insertion cam 24 or extraction cam 26 is accomplished similarly to insertion.

As is generally well known, a helical tension spring tends to twist or rotate out of plane when a torque is applied against a rotational resistance such that the pitch of the coils is reduced, a phenomenon also known as "helical buckling." Such a situation is described above in connection with a rotational force applied to the helical coil spring turning it into a respective threaded member 22, 23. This tendency to buckle or twist out of plane tends to be exaggerated at a directional change, i.e., a curve or bend. Therefore, a preferred embodiment of the invention provides spatially fixed stanchion 25 formed with respective channel or guide 90A and 90B for each of insertion drive element 20A and extraction drive element 20B, respectively. Respective guides 90A, 90B define the curvature of the directional change in respective drive elements 20A and 20B. Each guide 90 preferably substantially encompasses respective helical coil spring 98A, 98B, thereby constraining it to remain within predetermined confines. Preferably, the curvature of guides 90 is defined by the shape taken by respective helical coil spring 98A, 98B in its relaxed or unloaded condition, i.e., with no torque applied.

FIG. 1 further illustrates two relatively spatially fixed stanchions 92 and 94. Stanchions 92 and 94 provide support for insertion actuator drive elements 20A and 20B and define the configuration of actuator drive 20 on the circuit board. Insertion drive element 20A and extraction drive element 20B include respective flexible threaded rods 98A and 98B, which extend from adjacent to respective drive ends 56A and 56B of respective insertion cam 24 and extraction cam 26 through respective channel guides 90A and 90B toward an accessible portion of the circuit board. As discussed in further detail below, each of flexible threaded rods 98A and 98B are preferably guided and supported by respective tubular guides 102A and 102B at least between channel guides 90 and first stanchion 92. Tubular guides 102A, 102B substantially constrain flexible threaded rods 98A, 98B to maintain their straight tubular shape, and restrict their tendency to buckle or twist out of plane by shortening their unsupported columnar length. Accordingly, tubular guides 102 are configured to fit closely about the outer diameter of respective flexible rods 98. Each of tubular guides 102 is in turn positionally constrained relative to the circuit board by a mechanical interconnection with each of guide 90 and first stanchion 92. According to one embodiment of the invention, drive rods 72 are axially and/or rotationally fixed relative to flexible threaded rods 98 such that advancing or retracting flexible threaded rods 98 relative to respective threaded members 22, 23 similarly advances or retracts respective insertion cam 24 and extraction cam 26.

Figure 3A:
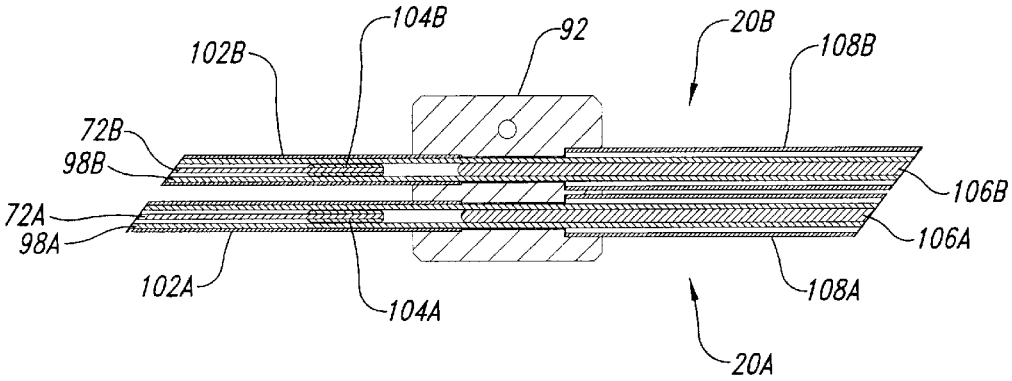
FIG. 3A illustrates an embodiment of the invention wherein a drive rod extends from within one of an insertion cam and an extraction cam toward a first stanchion in the direction of an input drive end of a respective actuator drive, wherein the drive rod is axially and rotationally fixed relative to a flexible threaded rod.

FIG. 3A illustrates an embodiment of the invention wherein drive rods 72 extend from within respective cavity 54A, 54B of insertion cam 24 and extraction cam 26 toward the drive input end of actuator drive 20, ending in the vicinity of first stanchion 92. Drive rods 72 are axially and rotationally fixed relative to respective flexible threaded rods 98 by mechanical bonding. According to one embodiment, a ferrule 104A and 104B is swaged onto a respective one of drive rod 72A and 72B at or near its end. Ferrules 104 are in turn mechanically bonded to flexible threaded rods 98 by, for example, soldering, welding, adhesive bonding, swaging, or another suitable mechanical fixing or attaching technique. Between first stanchion 92 and second stanchion 94, flexible threaded rods 98A and 98B are stiffened against buckling by internal support rods 106A and 106B, which substantially fill the tubular interior of respective flexible threaded rod 98A and 98B. Flexible threaded rods 98 are thereby converted into substantially rigid threaded members. Internal support rods 106 are alternatively either a substantially smooth rod fitting snugly within the internal diameter of the coils of the helical springs that form threaded rods 98, or a rigid threaded rod having a diameter and thread pitch substantially matched to the internal thread of flexible threaded rods 98 as defined by the interior surface of the individual coils of the springs. Thus, the flexibility of threaded rods 98 is reduced substantially so that, in operation, they act substantially like rigid members. Internal support rods 106 eliminate the usefulness of a tubular guide such as tubular guide 102. However, in a preferred embodiment, protective sheaths 108A and 108B provide barriers between respective threaded rods 98A and 98B and their environment that protect components on the circuit board. As shown in FIG. 1, sheaths 108 and 108B extend at least between first and second stanchions 92, 94 and, optionally, extend beyond stanchion 94.

Figure 3B:
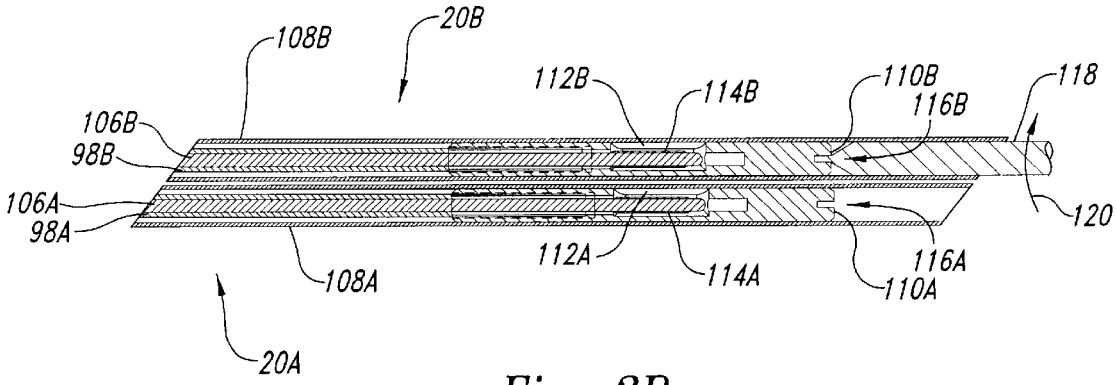
FIG. 3B is a section view of one embodiment of an actuator drive of the invention taken between a first and a second stanchion, wherein respective flexible threaded rods are terminated in a respective rotary drive input mechanism.

FIG. 3B is a section view of actuator drives 20 taken between first and second stanchions 92 and 94. In FIG. 3B, respective flexible threaded rods 98A and 98B are terminated in a respective rotary drive input mechanism 110A and 110B. Flexible threaded rods 98 are mechanically interfaced with rotary drive input mechanisms 110 such that rotation of input drive mechanisms 110, either clockwise or counterclockwise, results in a similar rotary motion of respective flexible threaded rods 98A and 98B. For example, flexible threaded rods 98 are threaded into internal threads of rotary drive input mechanisms 110 and staked to prevent relative rotation therebetween. Alternatively, flexible threaded rods 98 are otherwise mechanically fixed to prevent relative rotational motion with a respective rotary drive input mechanism 110 by, for example, welding, soldering, adhesive bonding, or another suitable mechanical fixing technique.

Internal support rods 106A, 106B are preferably fixed to prevent axial motion relative to drive input 110A and 110B, respectively. One method of axially fixing internal support rods 106 relative to respective flexible threaded rods 98 is shown in FIG. 3B, wherein an end of respective internal support rod 106A and 106B extends into a respective cavity 112A and 112B formed in respective rotary drive input mechanism 110A and 110B through an appropriately sized passage. An oversized ferrule 114A and 114B is staked, soldered, welded, adhesively bonded, or otherwise suitably mechanically fixed to respective internal support rod 106A, 106B. Oversized ferrules 114 cannot pass through the passage, and therefore fix internal support rods 106 axially and translationally relative to rotary drive input mechanisms 110. Rotary drive input mechanisms 110 further include mechanical adaptations for inputting a rotational force or torque. For example, an exposed or accessible surface of each rotary drive input mechanism 110A and 110B is fitted with a conventional rotational drive input structure, such as a screw driver slot 116A and 116B. Conventional rotational input drive structures 116A and 116B include a standard Phillips screwdriver slot, a straight slot for a flat bladed screwdriver, a star or hex drive, or another conventional screwdriver slot. Alternatively, rotary drive input mechanisms 110 are fitted with any of various proprietary rotational force input mechanisms.

In operation, a torque applied at either rotational force input slot 116 rotates a respective rotary drive input mechanism 110, which is rotationally fixed to, and in turn rotationally drives, a respective flexible threaded rod 98. Rotation of respective flexible threaded rods 98A, 98B advances respective flexible threaded rod 98A, 98B axially relative to respective threaded member 22, 23. Drive rods 72, which are axially fixed relative to flexible threaded rods 98, similarly advance relative to threaded members 22, 23. Advancing drive rods 72A and 72B imparts a linear translational motion to a respective one of insertion cam 24 and extraction cam 26 along their respective linear actuator guides 40A and 40B within actuator cam assembly 30.

Figure 4:
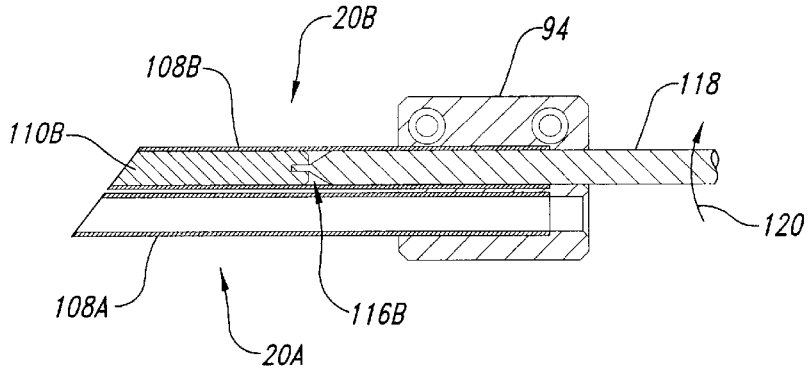
FIG. 4 illustrates an embodiment of the invention wherein a protective sheath formed around the flexible threaded rod terminates at the second stanchion.

FIG. 4 illustrates an embodiment of the invention wherein protective sheaths 108 around flexible threaded rods 98 terminate at second stanchion 94. Rotational torque input device 118 is shown as the shaft of a screwdriver adapted for mating with screwdriver slot 116B in rotary drive input mechanism 110B for input of a drive torque represented by arrow 120.

Figure 5A:
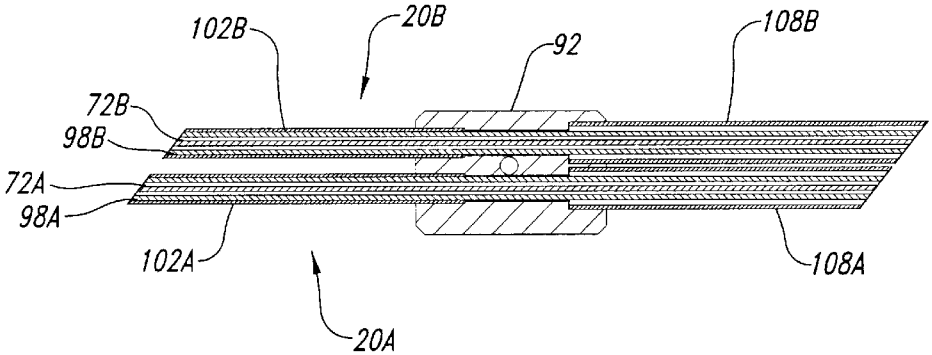
FIG. 5A illustrates another embodiment of the actuator drive mechanism of the invention.

FIG. 5A illustrates another embodiment of actuator drive mechanisms 20 of the invention. Tubular guides 102A, 102B again extend between respective channel guides 90A and 90B and first stanchion 92 to guide and support flexible threaded rod 98A and 98B, respectively. Protective tubular sheaths 108A and 108B also extend between first and second stanchions 92 and 94 as described above. According to the embodiment illustrated in FIG. 5A, drive rods 72A and 72B continue past first stanchion 92 and terminate at respective rotary drive input mechanisms 122A and 122B, shown in FIG. 5B.

Figure 5B:
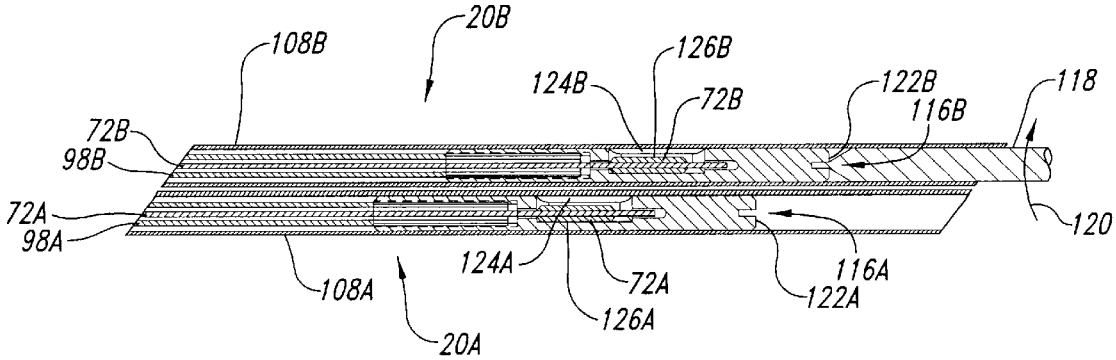
FIG. 5B illustrates one embodiment of the termination of both the flexible threaded rods and the flexible drive rods of the invention at respective rotary drive inputs.

FIG. 5B illustrates the termination of both flexible threaded rods 98A and 98B and flexible drive rods 72A and 72B at respective rotary drive input mechanisms 122A and 122B. As described above, flexible threaded rods 98A and 98B terminate at internally threaded cavities formed in respective rotary drive input mechanisms 122A and 122B. Preferably, flexible threaded rods 98 are rotationally fixed relative to rotary drive input mechanisms 122 by a suitable mechanical means, such as described above. Wire drive rods 72A and 72B pass into respective cavities 124A and 124B formed in respective rotary drive input mechanisms 122A and 122B through appropriately sized clearance holes. Wire drive rods 72A and 72B are terminated in respective cavities 124A and 124B. Preferably, drive rods 72A, 72B are terminated in such manner that axial motion relative to respective flexible threaded rods 98A, 98B is substantially restricted. Accordingly, drive rods 72A and 72B are, for example, fitted with a respective ferrule 126A and 126B which is soldered, welded, swaged, adhesively bonded, or otherwise mechanically fixed in axial relationship thereto. An accessible surface of rotary drive input mechanisms 122A, 122B is adapted for inputting a rotational force such as torque 120 similarly to rotary drive input mechanisms 110, discussed above. For example, a screwdriver slot 116 is provided for inputting a rotational force such as torque 120 via screwdriver 118, as shown in FIG. 4.

Figure 6A:
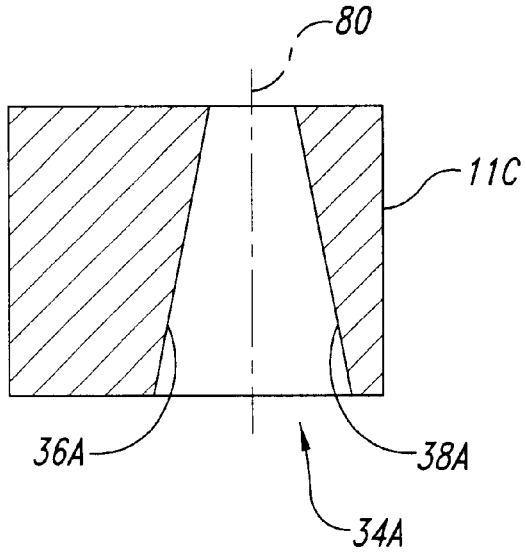
FIG. 6A illustrates one embodiment of the mobile connector element of the invention, including first and second spaced apart inclined drive surfaces forming a truncated isosceles triangular cavity having its base facing toward the actuator.
Figure 6B:
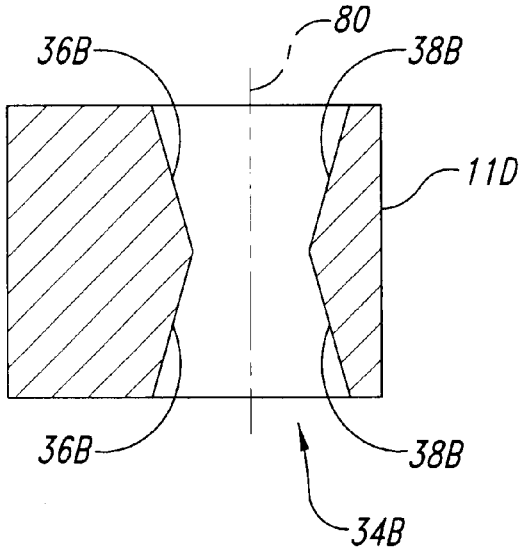
FIG. 6B illustrates another embodiment of the mobile connector element of the invention, including a pair of spaced apart angular surfaces, each including a pair of intersecting surfaces, that together form a pair of cavities describing isosceles triangles intersecting and mutually truncating one another along an engagement axis between the stationary and mobile connector elements.

FIGS. 6A and 6B illustrate two additional embodiments of movable connector element 11B, wherein drive surfaces 36, 38 are configured with an incline. According to one additional configuration shown in FIG. 6A, mobile connector element 11C includes first and second spaced apart inclined drive surfaces 36A and 38A. Together, inclined insertion drive surface 36A and inclined extraction drive surface 38A form a truncated isosceles triangular slot 34A having its base facing toward cam assembly 30.

FIG. 6B illustrates mobile connector element 11D formed with a pair of spaced apart angular surfaces 36B and 38B, each including a pair of intersecting surfaces. Angular surfaces 36B and 38B together form a pair of slots describing isosceles triangles intersecting and mutually truncating one another along engagement axis 32 and having respective bases formed at opposing openings in slot 34B facing, respectively, toward and away from cam assembly 30. Preferably, the angle of inclined actuation surface 52A and the angles of inclined drive surfaces 36A and 36B are substantially identical, such that engagement of inclined actuation surface 52A with one of inclined drive surfaces 36A and 36B results in a substantially planar engagement. In contrast, engagement is linear between inclined actuation surface 52A and drive surface 36, which is shown in FIG. 2A as formed substantially parallel to longitudinal axis 80 of slot 34. Use of an inclined surface for drive surfaces 36A, 36B provides more uniform loading or pressure against drive surface 36A, 36B as engagement with inclined actuation surface 52A increases. Also, such mutually inclined surfaces move the center of pressure on respective mobile connector elements 11C and 11D toward coincidence with engagement axis 32. In contrast, interaction between inclined actuation surface 52A and parallel insertion drive surface 36 limits the pressure to a line intersection at the opening to slot 34.

Figure 7A:
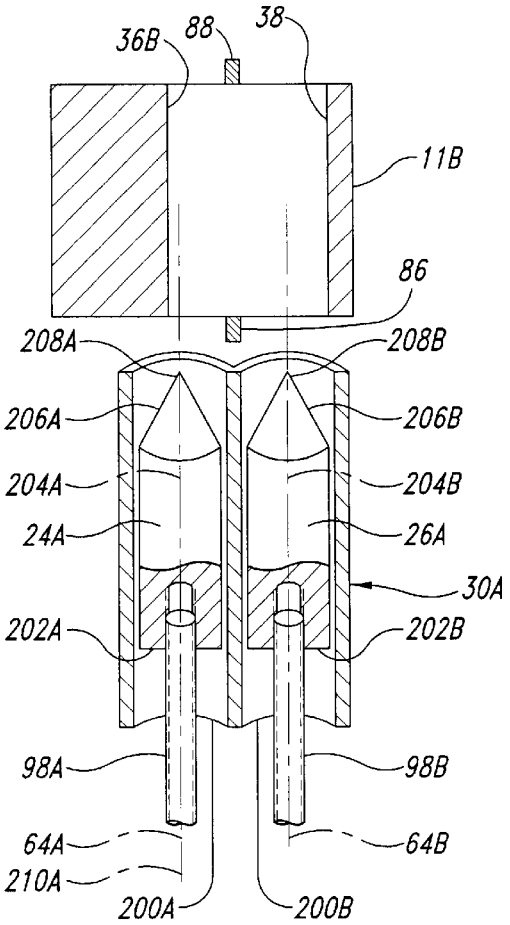
FIG. 7A illustrates one embodiment of the actuator of the invention that includes a cylindrical actuator cam slidingly engaged with a tubular insertion cam guide of the invention, wherein the cylindrical body of the actuator cam includes a conical actuation surface.
Figure 7B:
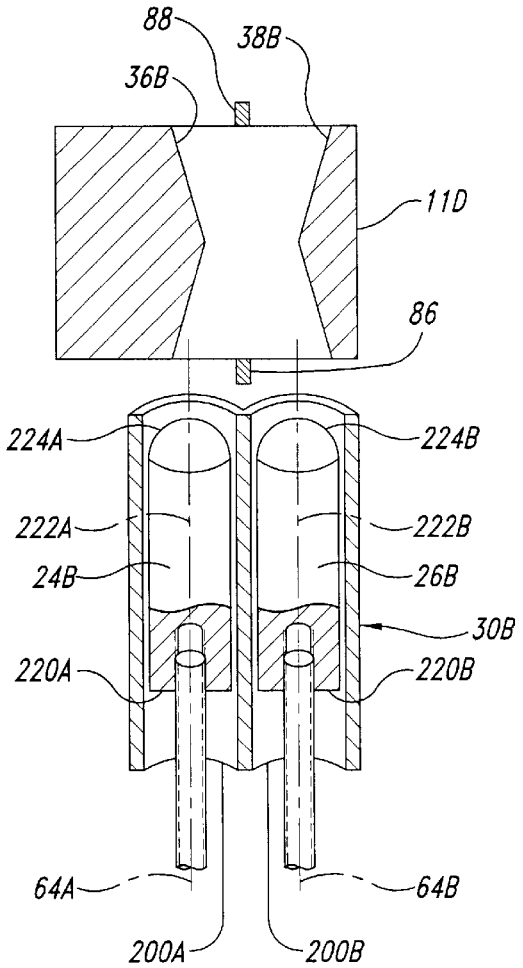
FIG. 7B illustrates another embodiment of the actuator of the invention that includes a cylindrical actuator cam slidingly engaged with a tubular insertion cam guide of the invention, wherein the cylindrical body of the actuator cam includes a curved actuation surface.

FIGS. 7A and 7B illustrate two additional embodiments of actuator cam assembly 30. The additional embodiments are described in relation only to insertion cam 24. However, the embodiments are similarly applicable to extraction cam 26. In FIG. 7A, actuator cam assembly 30A includes a cylindrical insertion cam 24A slidingly engaged with a tubular insertion cam guide 200A. Cylindrical body 202A of insertion cam 24A defines a longitudinal axis 204A that is coaxial with longitudinal axis 64A of tubular insertion cam guide 200A. A conical actuation surface 206A is coaxial with and extends from cylinder 202A toward movable connector element 11B and is tipped by a conical actuator tip 208A. Extraction cam 26A is similarly configured as a cylinder 202B slidingly engaged with tubular extraction cam guide 200B and defines a longitudinal axis 204B that is coaxial with longitudinal axis 64B thereof. Cylindrical extraction cam 26A similarly includes a coaxial conical actuation surface 206B that extends toward movable connector element 11B and is similarly tipped with a coaxial conical actuator tip 208B. Actuator cam assembly 30A is positioned and operates substantially the same as actuator cam assembly 30, described above. Cylindrical insertion cam 24A is threadedly driven into slot 34 of mobile connector element 11B by insertion actuator drive 20A, whereby first conical actuator tip 208A and then conical actuation surface 206B engage insertion actuation drive surface 36. The inclined nature of the conical surfaces act similarly to inclined actuation surface 52A of insertion actuator cam 24 to gently urge mobile connector element into engagement with mating stationary connector element 11A.

According to one embodiment of the invention, conical actuator surfaces 206A and 206B of respective cylindrical actuator cams 24A and 26A are optionally configured with respective internal cavities 54A and 54B and fitted to respective drive rods 72A and 72B of earlier described threaded insertion actuator drive 20A. The conical nature of actuator cam assembly 30A, however, provides opportunities for other configurations of actuator drive 20. All surfaces of conical drive tips 208A, 208B and conical actuation surfaces 206A, 206B are identically inclined surfaces. Therefore, cylindrical insertion and extraction cams 24A and 26A are optionally allowed to rotate relative to respective insertion and extraction drive surfaces 36 and 38 of mobile connector element 11B. Rotatable insertion and extraction actuator cams 24A and 26A are connected directly to respective threaded rods 98A and 98B, without respective intermediary drive rods 72A and 72B. Threaded rods 98 are mechanically affixed to actuator cams 24A, 26A using any of the above described means or another suitable means, thus simplifying the drive mechanism.

Furthermore, rotatable insertion and extraction actuator cams 24A and 26A are optionally used in combination with either of additional embodiments 11C and 11D of mobile connector element 11B. Preferably, conical actuation surface 206A of insertion actuator cam 24A is formed with an incline substantially matched to the incline of corresponding insertion drive surfaces 36A and 36B of respective mobile connector elements 11C and 11D. Similarly, conical actuation surface 206B of extraction actuator cam 26A is preferably formed with an incline substantially matched to the incline of corresponding extraction drive surfaces 38A and 38B of respective mobile connector elements 11C and 11D.

FIG. 7B illustrates another additionally embodiment of actuator cam assembly 30. In FIG. 7B, actuator cam assembly 30B includes insertion and extraction cams 24B and 26B configured with respective cylindrical bodies 220A and 220B, which are slidingly engaged with respective tubular cam guides 200A and 200B. Cylindrical insertion cam 24B defines a longitudinal axis 222A that is coincident with longitudinal axis 64A of tubular insertion cam guide 200A. Within tubular extraction cam guide 200B, cylindrical extraction cam 26B defines a longitudinal axis 222B that is coincident with longitudinal axis 64B. Insertion and extraction cams 24B and 26B are further configured with respective rounded actuator tips 224A and 224B, which extend from respective cylindrical bodies 220A and 220B toward slot 34B of mobile connector element 11D.

Actuator cam assembly 30B is positioned and operates substantially the same as actuator cam assemblies 30 and 30A, described above. Cylindrical insertion cam 24B is threadedly driven into slot 34B of mobile connector element 11D by insertion actuator drive 20A, whereby rounded actuation surface 224B engages inclined insertion actuation drive surface 36B. An inclined drive surface is preferred to interact with rounded actuation surface 224B. The inclined drive surface of the mobile connector element acts similarly to inclined actuator surface 52A of insertion actuator cam 24, allowing rounded actuation surface 224A to gently urge mobile connector element 11B into engagement with mating stationary connector element 11A. Such an inclined drive surface is provided by insertion drive surface 36A in mobile connector element 11C, and by insertion drive surface 36B in mobile connector element 11D, as described above. Extraction cam 26B is similarly operated.

According to one embodiment of the invention, rounded actuator surfaces 224A and 224B of respective cylindrical actuator cams 24B and 26B are optionally configured with respective internal cavities 54A and 54B and fitted to respective drive rods 72A and 72B of earlier described threaded insertion actuator drive 20A. According to the present embodiment of the invention, however, the cylindrical and rounded nature of actuator cam assembly 30B provides that all surfaces of rounded actuation surfaces 224A, 224B are identically rounded surfaces. Therefore, cylindrical insertion and extraction cams 24B and 26B are optionally allowed to rotate relative to respective insertion and extraction drive surfaces 36B and 38B of mobile connector element 11D. Rotatable insertion and extraction actuator cams 24B and 26B are connected directly to respective threaded rods 98A and 98B, without respective intermediary drive rods 72A and 72B. Threaded rods 98 are mechanically affixed to actuator cams 24A, 26A using any of the above described means or another suitable means, thus simplifying the drive mechanism.

Figure 8:
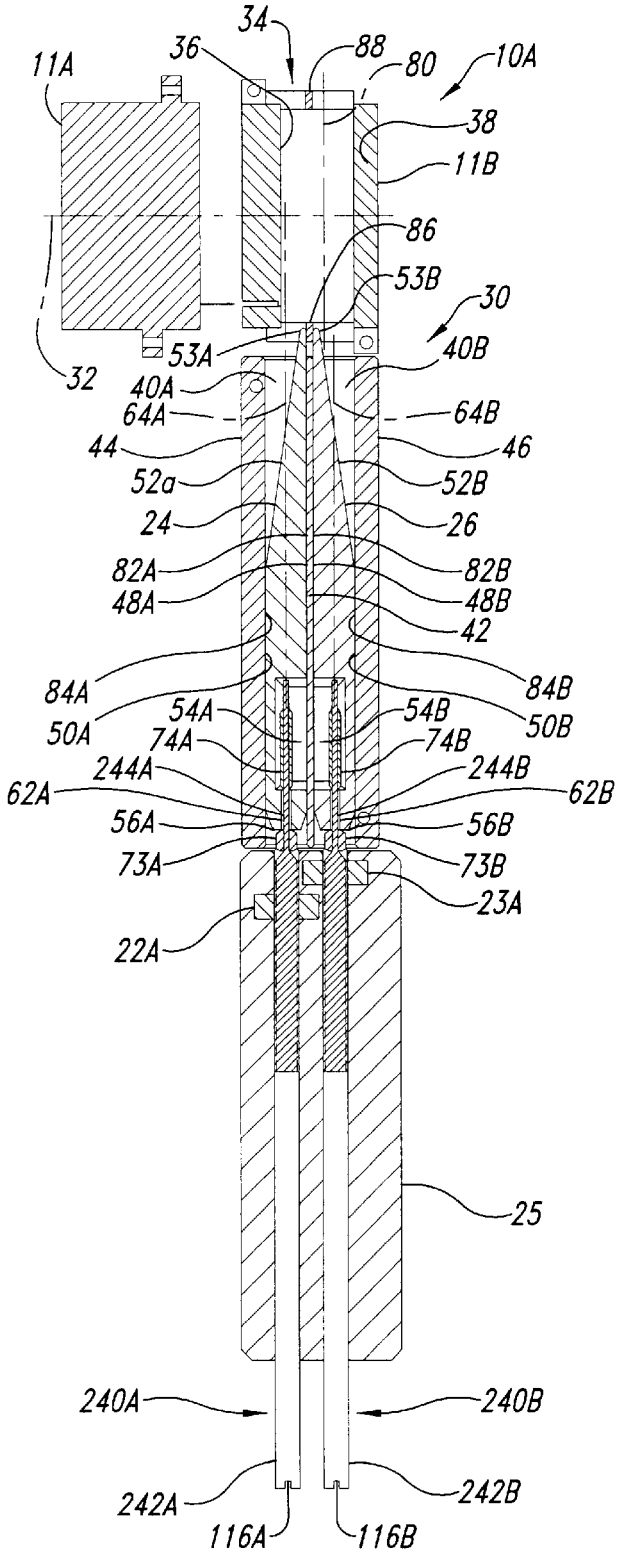
FIG. 8 illustrates the non-flexing actuator drive elements of the invention.

FIG. 8 illustrates the use of rigid, non-flexing actuator drive elements 240A and 240B in place of flexible actuator drive elements 20A and 20B. Rigid actuator drive elements are appropriate in an application wherein access is available along longitudinal axes 64A and 64B of respective actuator guides 40A and 40B. Preferably, insertion actuator drive 240A and extraction actuator drive 240B are formed as respective rods 242A and 242B, each threaded with a standard machine thread and configured with a respective rotational drive input 116A and 116B, as described above. Actuator drive rods 242A and 242B threadedly engage respective nuts 22 and 23, which convert torque into linear translational force along their respective longitudinal axes.

Actuator drive rods 242A and 242B are terminated in any of several suitable terminations that tie the linear translation of respective insertion and extraction cams 24 and 26 along respective actuator guide longitudinal axes 64A and 64B to the linear motion of a respective actuator drive rod 242A and 242B. For example, the diameter of each of actuator drive 242A and 242B is necked-down to form respective reduced diameter drive rods 244A and 244B that extend through appropriately sized clearance passages 62 into cavities 54 of respective insertion and extraction cams 24 and 26. Rotation of reduced diameter drive rods 244A and 244B relative to stanchion 25 is preferably eased by respective bushings or bearings 73A and 73B.

Reduced diameter drive rods 244A and 244B are fixed against relative linear translational motion with respective actuator drive rods 242A and 242B while retaining rotational freedom relative to respective insertion and extraction cams 24 and 26. Relative linear translational motion is restricted by, for example, expanding the diameter of drive rods 244A and 244B within cavities 54. As described above, according to one embodiment of the invention, a metallic ferrule 74 is fixed to each drive rod 244 within cavity 54 by any of staking, welding, soldering, fixing with an adhesive, or another suitable mechanical fixing method. Alternatively, reduced diameter drive rods 244 are threaded and a corresponding threaded element, such as a standard hex or lock nut is engaged therewith within cavity 54. Thus, insertion and extraction cams 24, 26 advance and retreat responsively to a positive or negative torque applied to respective drive rod 242A and 242B.

Figure 9A:
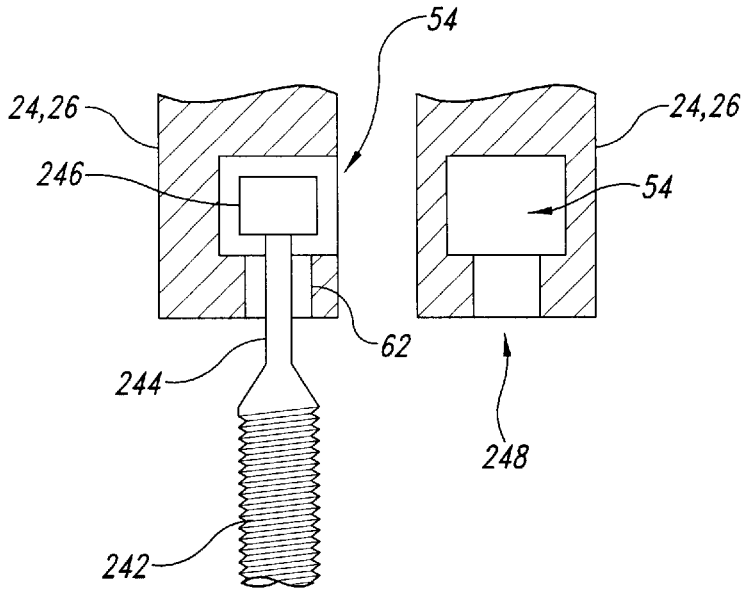
FIG. 9A illustrates one mechanism for securing the drive relative to respective actuator cams according to one embodiment of the invention.
Figure 9B:
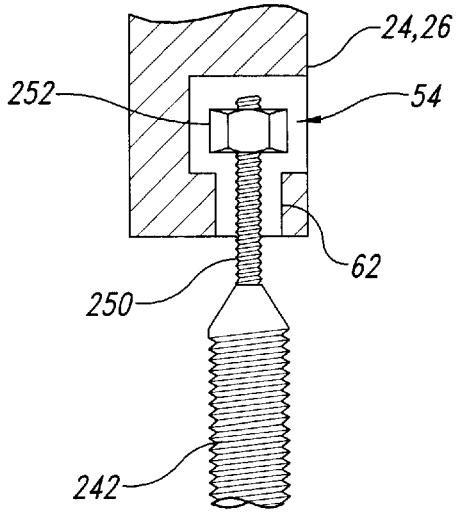
FIG. 9B illustrates another mechanism for securing the drive relative to respective actuator cams according to one embodiment of the invention.

FIGS. 9A and 9B illustrate two embodiments of the invention describing mechanisms for securing drive rods 242A and 242B relative to respective insertion and extraction cams 24 and 26. In FIG. 9A, for example, drive rod 242 is necked-down at reduced diameter portion 244 to clear passage 62, but maintained at it's a larger or full diameter at its tip 246. Necked-down portion 244 is passed through slot 248 in one of insertion and extraction cam 24, 26 into passage 56, where relative rotational freedom between drive rod 242 and cam 24, 26 is maintained. Enlarged tip 246 is simultaneously installed into cavity 54, thereby securing relative translation between drive rod 242 and cam 24, 26.

FIG. 9B illustrates one of drive rods 242A and 242B configured with a necked-down end portion 250 that extends through clearance passage 62 into cavity 54. Necked-down portion 250 is optionally secured within cavity 54 by any of the mechanisms utilized to secure drive rod 72. Alternatively, necked-down portion 250 is threaded and secured with a hex or lock nut 252. Thus, relative translational motion between drive rod 242 and cam 24, 26 is secured, while relative rotational independence is maintained.

Circuit Board Installation Embodiment

The present invention is preferably applied to the installation of circuit boards into computer cabinets. Many such installations are made difficult by having multiple circuit boards interconnecting with an interface board, such as a mother board, back plane, or another interface board mounted opposite the access panel. Interconnections are often made by mating connectors on the installed circuit board with connectors already mounted on the an interface board. In crowded installations the connectors must be mated blindly. When a large number of connections are needed, the connectors may be small and the pins slender and delicate. The very act of installing circuit board 2 may bend or crush the connector pins when circuit board 2 is seated.

Figure 10:
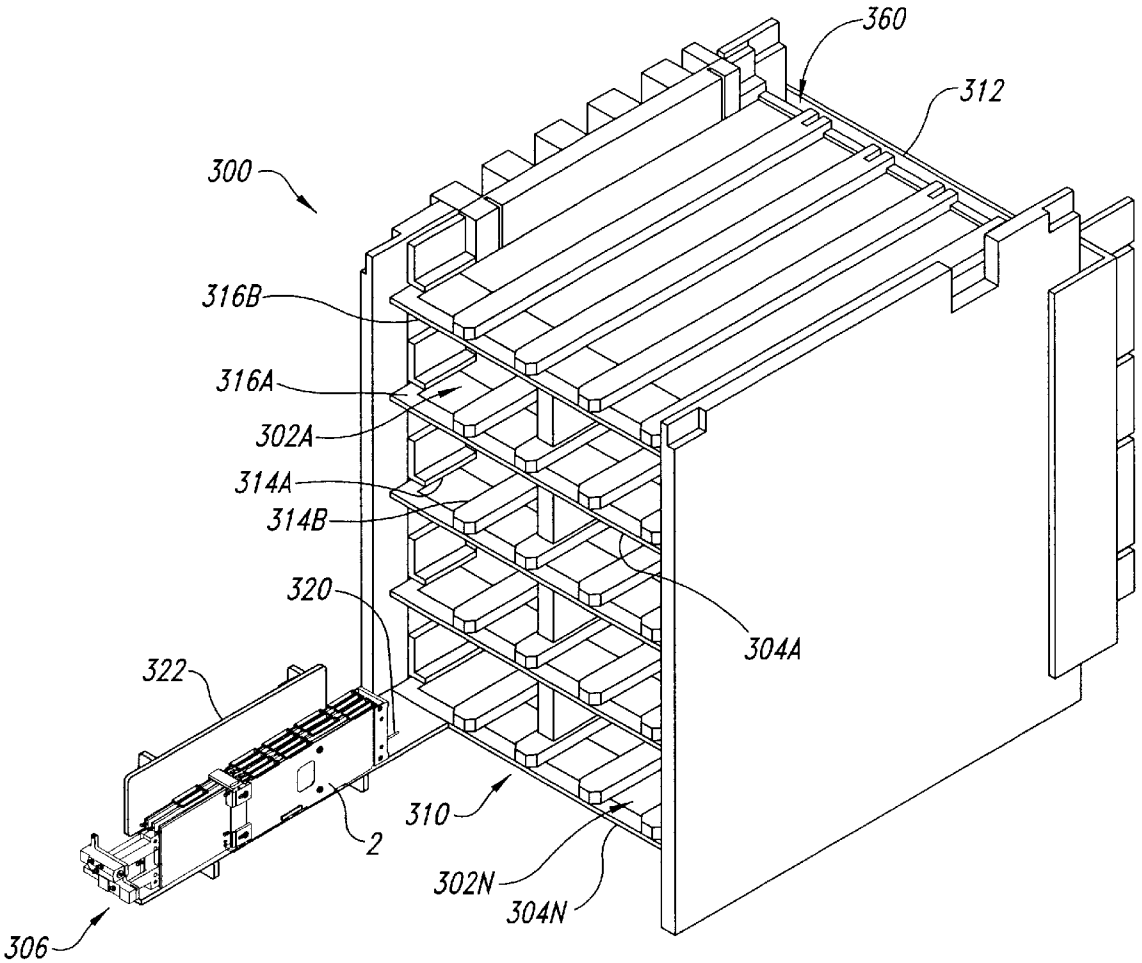
FIG. 10 illustrates a computer cabinet according to one embodiment of the invention, including an array of slots in multiple racks each accepting an assembly of several circuit boards from a tray.

FIG. 10 illustrates a crowded computer cabinet 300 having an array of slots 302 in multiple racks 304, each accepting an assembly 306 of several circuit boards 2 from a tray 308. Computer cabinet 300 provides an access opening 310 for installing circuit board assemblies 306. Opposite access 310 another circuit board, mother board, back plane or other interface board 312 is provided with multiple stationary connector elements 11A (shown in FIGS. 1 and 2) for mating with movable connectors 11B mounted on individual circuit boards 2. Stationary connector elements 11A, for example, provide electrical interconnection between individual circuit boards 2 mounted in a single assembly 306, or electrically interconnect circuit boards 2 mounted on different assemblies 306A through 306N (not shown) installed into different slots 302A through 302N.

Each slot 302 provides a pair of substantially parallel guide strips 314A and 314B horizontally spaced-apart a first predetermined distance and, preferably, provided with a bevel or chamfer lead-in that engages circuit board assembly 306. Furthermore, substantially parallel, vertically opposing surfaces 316A and 316B of slots 302 are preferable spaced a second predetermined distance apart. Preferably, each slot 302 is equipped with a precision docking receptacle (not shown) slidingly accepting an alignment pin 320 mounted on circuit board assembly 306. Interface board 312 is spatially fixed adjacent to the back of cabinet 300 opposite access opening 310. Interface board 312 includes an array of stationary connector elements 11A (not shown) oriented to mate with corresponding movable connector elements on individual circuit boards 2.

Tray 322 provides mechanical support and guidance during installation of circuit board assemblies 306, including initial alignment with slot 302. Circuit board assembly 306 presents both alignment pin 320 and mobile connector elements 11B (shown in FIG. 11) facing respective mating docking receptacle and stationary connector elements 11A (not shown). Each circuit board assembly 306 is pushed, manually for example, into a corresponding slot 302, sliding between opposing, horizontally spaced-apart guide strips 314A and 314B and between opposing, vertically spaced-apart surfaces 316A and 316B.

Figure 11:
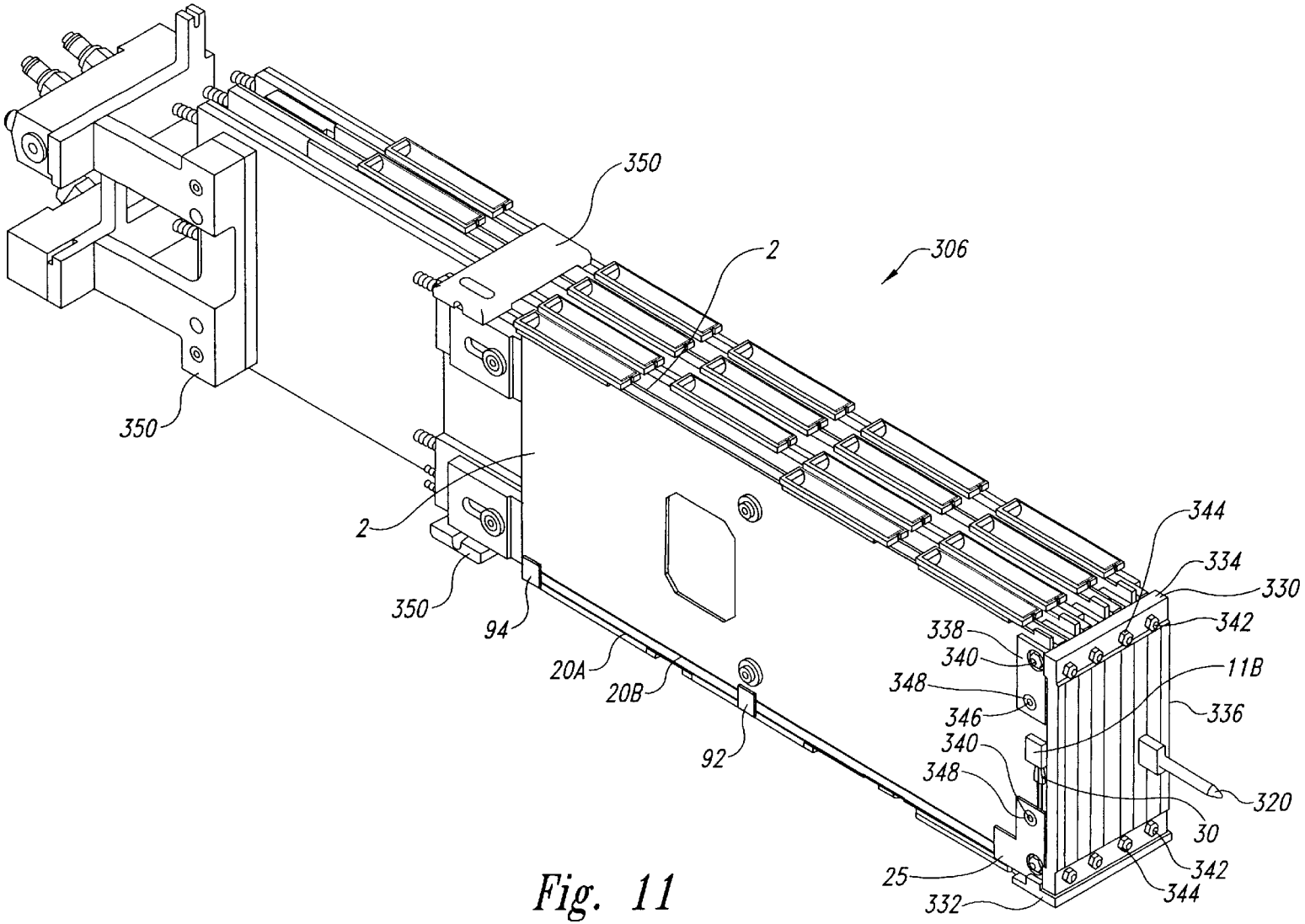
FIG. 11 illustrates one embodiment of circuit board assembly of the invention, including multiple individual circuit boards.

FIG. 11 illustrates one embodiment of circuit board assembly 306 of the invention, including multiple individual circuit boards 2. Each assembly 306 includes a frame 330, including at least a shoe 332 and a header 334 rigidly interconnected by one or more uprights 336. A bracket 338 is securely attached to each circuit board 2, for example, by one or more fasteners 340, by adhesive bonding, or by another suitable mechanism. Each bracket 338 includes means for mechanically attachment to frame 330. For example, one or more threaded studs 342 project from a surface of bracket 338 and extend through corresponding holes formed in one, two, or all of shoe 332, header 334, and uprights 336. Each threaded stud 342 is secured to frame 330 by a nut 344. Thus, each individual circuit board 2 is securely fixed relative to one or more of shoe 332, header 334, and uprights 336 with a precision that depends upon such factors as: the accuracy with which bracket 338 is aligned with circuit board 2; the clearance between the hole through which threaded stud 342 passes and threaded stud 342; and the accuracy of another means of aligning circuit board 2 with one or more elements of frame 330; as well as other factors. Individual circuit boards 2 are preferably precisely aligned with frame 330, for example, by precision pins 346 mounted on each bracket 338 fitted into precision holes 348 in circuit boards 2. Studs 342 preferably include a precision shaft (not shown) at the base of the threaded section fitted into precision holes in one or more of shoe 332, header 334, and uprights 336. Moveable connector elements 11B are similarly precisely located relative to circuit board 2.

Shoe 332 is preferably sized to pass between opposing, horizontally spaced-apart guide strips 314A and 314B with a precision slip fit for accurate alignment with interface board 312 at the end of each slot 302. The combination of shoe 332, header 334, and uprights 336 is preferably sized to pass between opposing, vertically spaced-apart surfaces 316A and 316B with a precision slip fit for accurate alignment with interface board 312 at the end of each slot 302. Frame 330 preferably includes one or more additional frame members 350 relatively aligning and securing the ends of individual circuit boards 2.

Alignment pins 320 mounted on and projecting from frames 330 of circuit board assemblies 306 are guided to precise locations relative to interface board 312 by the close fit between each circuit board assembly 306 and corresponding slot 302. Either interface board 312 or a portion of cabinet 300 in the vicinity of interface board 312 and precisely aligned with interface board 312 includes multiple mating docking receptacles (not shown) precisely matched to alignment pins 320. Insertion of each alignment pin 320 into a corresponding docking receptacle accurately aligns each individual circuit board 2 of a corresponding assembly 306 with interface board 312.

Upon insertion of circuit board assembly 306 fully into slot 302, with the precision fit of frame 330 and alignment pin 320 or another alignment means aligning each moveable connector element 11B in relative insertion orientation with a corresponding mating stationary connector element 11A on interface board 312, insertion of moveable connectors into stationary connector elements 11A is performed. As described above, a torque is applied to insertion actuator 20A and is converted by engagement with threaded member 22A into linear force that drives insertion cam 24 against insertion drive surface 36 of moveable connector element 11B, gently easing it into mating contact with corresponding stationary connector element 11A.

Disengagement of moveable connector element 11B from stationary connector element 11A is accomplished when desired by retracting insertion cam 24 into actuator cam assembly 30 and applying a rotational force or torque to extraction actuator 20B. Torque applied to extraction actuator 20B is converted by engagement with threaded member 23A into a linear force that drives extraction cam 26 against extraction drive surface 38 of moveable connector element 11B, gently easing it out of mating contact with corresponding stationary connector element 11A. Circuit board assembly 306 is removed by pulling, manually for example, along slot 302 oppositely from interface board 312.

According to an alternative embodiment, cabinet 300 includes access 360 (shown in FIG. 10) perpendicular to interface board 312 in line with mating movable connector elements 11B on installed circuit boards 2 of assemblies 306.

Accordingly, access opening 360 provides access into cabinet 300 along longitudinal axes 64A and 64B of respective actuator guides 40A and 40B. Thus, respective rotational drive inputs 116A and 116B of rigid insertion actuator drive 240A and rigid extraction actuator drive 240B (shown in FIG. 8) are accessible to apply respective installation and extraction torques along respective longitudinal axes 64A and 64B.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An electrical cabinet and circuit board assembly comprising:

an electrical cabinet formed with an array of slots each having access provided adjacent to a first surface of the cabinet and a connector end adjacent to a second opposing surface of the cabinet;

a first stationary connector element adjacent to the connector end of the slots, the stationary connector element defining a connector engagement axis;

a circuit board adapted for entry into one of the slots and including:

a second connector element movable along the connector engagement axis for interconnecting with the first stationary connector element, an internally-threaded member that is positionally fixed on the circuit board relative to the connector engagement axis, and a rotary drive insertion device having a substantially flexible, externally-threaded rod executing at least one directional change between a first drive input end and a second drive output end, the drive output end engaged with both the internally-threaded member and the second connector element for moving the second connector element along the engagement axis.

2. The device of claim 1, wherein the substantially flexible rod describes a predetermined curving trajectory between the first drive input end and the second drive output end and including the directional change.

3. The device of claim 2, further comprising a stanchion restraining the first drive input end of the flexible rod for motion along the predetermined trajectory.

4. The device of claim 3, further comprising a tubular guide surrounding at least a portion of the flexible rod.

5. The device of claim 1, wherein the movable connector element is formed with an insertion drive surface oriented relatively to the engagement axis;

further comprising an insertion cam positioned proximately to the movable connector element and having an inclined actuation surface facing toward and spaced away from the insertion drive surface along an axis perpendicular to the engagement axis and intersecting the insertion drive surface, the insertion cam movable along the perpendicular axis; and wherein the second drive output end of the rotary drive insertion device is configured for motion parallel to the axis perpendicular to the engagement axis and intersecting the insertion drive surface and engages the insertion cam.

6. The device of claim 5, wherein the circuit board further comprises a stationary insertion cam guide slidingly engaging the insertion cam.

7. The device of claim 6, wherein the insertion drive surface of the movable connector element further comprises an inclined surface.

8. The device of claim 7, wherein each of the insertion drive surface of the movable connector element and the actuation surface of the insertion drive cam further comprise matchingly inclined drive surfaces.

9. The device of claim 8, wherein:

the movable connector element further comprises an extraction drive surface oriented relatively to the engagement axis;

the circuit board further comprises:

an extraction cam positioned proximately to the movable connector element and having an actuation surface facing toward and spaced away from the extraction drive surface along an axis perpendicular to the engagement axis and intersecting the extraction drive surface, the extraction cam movable along the perpendicular axis, a second internally-threaded member that is positionally fixed on the circuit board relative to the connector engagement axis, and a rotary drive extraction device having a substantially flexible, externally-threaded rod executing at least one directional change between a first drive input end and a second drive output end, the drive output end engaged with the second internally-threaded member for motion parallel to the axis perpendicular to the engagement axis and engaged with the extraction cam for moving the extraction cam along the perpendicular axis, whereby the movable connector element is moved along the engagement axis away from the first stationary connector element.

10. The device of claim 9, wherein the circuit board further comprises a stationary extraction cam guide slidingly engaging the extraction cam.

11. The device of claim 1, wherein:

the flexible threaded rod of the rotary drive insertion device further comprises a compressively wound helical coil spring having coils defining screw threads; and the flexible threaded rod of the rotary drive extraction device further comprises a compressively wound helical coil spring having coils defining screw threads.

12. The device of claim 11, wherein the circuit board further comprises one or more stanchions substantially encompassing a portion of one of the flexible threaded rods.

13. The device of claim 12, further comprising a tubular guide surrounding at least a portion of the flexible rod of the rotary drive extraction device.

14. An electrical cabinet including remote connector installation device comprising:

a cabinet formed with a plurality of rows and columns of elongated slots each open at opposing ends;

an interface board mounted on the cabinet covering first ones of the opposing ends of the slots and including a plurality of first electrical connector elements affixed thereto and oriented with first electrical interfaces projecting toward corresponding slots;

a plurality of circuit boards comprising:

a second connector element with a second electrical interface projecting toward the first electrical interfaces of corresponding first connector elements and translatable along an engagement path between disengaged and engaged positions relative to a corresponding first connector element, and a remotely controllable actuator disposed in a plurality of drive relationships to the second translatable connector element comprising:

a first drive relationship of the remotely controllable actuator to the second translatable connector element engaging the electrical interface of the second translatable connector element with the electrical interface of the corresponding first electrical connector element, a second drive relationship of the remotely controllable actuator to the second translatable connector element disengaging the electrical interface of the second translatable connector element from the electrical interface of the corresponding first electrical connector element, a threaded interface mounted on the circuit board in fixed relationship to the second translatable connector element and to the engagement path, and a flexible threaded drive engaged with the threaded interface and coupled to the translatable connector for urging the translatable connector along the engagement path.

15. The electrical cabinet of claim 14, wherein the flexible threaded drive further comprises a compressively wound helical coil spring having coils defining screw threads.

16. The electrical cabinet of claim 15, further comprising a tubular guide member mounted on the circuit board in fixed relationship to the threaded interface and encasing a portion of the helical coil spring.

17. The electrical cabinet of claim 16, further comprising first and second flexible threaded drives, wherein:

the first insertion drive is coupled to the translatable connector for urging the translatable connector toward the corresponding first connector element; and the second extraction drive is coupled to the translatable connector for urging the translatable connector away from the corresponding first connector element.

18. The electrical cabinet of claim 17, wherein:

the remotely controllable actuator further comprises a plurality of actuation surfaces disposed in a plurality of drive relationships to the second translatable connector element;

the first drive relationship further comprises an insertion actuation surface of the actuator disposed in contact with an insertion drive surface of the second translatable connector element, and the first insertion drive coupled to the actuator for moving the insertion actuation surface into contact with the insertion drive surface and urging the second translatable connector element along the engagement path toward the corresponding first electrical connector element; and the second drive relationship further comprises an extraction actuation surface of the actuator disposed in contact with an extraction drive surface of the second translatable connector element, and the second extraction drive coupled to the actuator for moving the insertion actuation surface into contact with the extraction drive surface and urging the second translatable connector element along the engagement axis away from the corresponding first electrical connector element.

19. The electrical cabinet of claim 16, wherein an interior portion of the coils describe a tubular interior space within the helical coil spring and extending between a first drive input end and a second drive output end of the flexible threaded drive; and further comprising a drive rod residing within the tubular interior space, a first portion of the smooth drive rod fixed to a portion of the helical coil spring and a second portion of the drive rod extending from an end of the helical coil spring at the drive output end of the flexible threaded drive and coupled to the second translatable connector element.

20. The electrical cabinet of claim 19, wherein the drive rod is formed as flexible drive rod and extends from the drive output end of the flexible threaded drive to a first predetermined point along the interior length of the helical coil spring adjacent to the drive input end of the flexible threaded drive to which the flexible drive rod is fixed.

21. The electrical cabinet of claim 19, wherein the drive rod is formed in two portions:

a first portion being flexible and extending from the drive output end of the flexible threaded drive to a first predetermined point intermediate along the interior length of the helical coil spring to which the flexible drive rod is fixed; and a second portion being rigid relative to the first flexible portion and extending from adjacent to the drive input end of the flexible threaded drive to a second predetermined a second intermediate point along the interior length of the helical coil spring adjacent the first predetermined intermediate point, the second portion being further rotationally coupled to the helical coil spring.

22. The electrical cabinet of claim 16, wherein the plurality of circuit boards further comprises a plurality of circuit board assemblies each including a plurality of circuit boards secured relative to a frame.

23. The electrical cabinet of claim 22, wherein each of the elongated slots further comprises guides slidingly engaging the frame of the circuit board assembly.

24. The electrical cabinet of claim 23, wherein the frame of each circuit board assembly further comprises one of a precision width dimension and a precision height dimension and each slot further comprises a corresponding precision dimension sufficiently larger to permit a sliding fit of the frame therein.

* * * * *